US010471673B2

(12) United States Patent
Schwelling

(10) Patent No.: US 10,471,673 B2
(45) Date of Patent: Nov. 12, 2019

(54) BALING PRESS

(71) Applicant: Hermann Schwelling, Salem (DE)

(72) Inventor: Hermann Schwelling, Salem (DE)

( * ) Notice: Subject to any disclaimer, the term of this patent is extended or adjusted under 35 U.S.C. 154(b) by 1075 days.

(21) Appl. No.: 14/702,119

(22) Filed: May 1, 2015

(65) Prior Publication Data

US 2015/0314548 A1 Nov. 5, 2015

(30) Foreign Application Priority Data

May 4, 2014 (DE) ..... 10 2014 106 181

(51) Int. Cl.

| | |
|---|---|
| ***B30B 15/24*** | (2006.01) |
| ***B30B 15/32*** | (2006.01) |
| ***B30B 1/34*** | (2006.01) |
| ***B30B 9/30*** | (2006.01) |
| ***B30B 15/00*** | (2006.01) |

(52) U.S. Cl.

CPC ..... *B30B 15/24* (2013.01); *B30B 1/34* (2013.01); *B30B 9/3007* (2013.01); *B30B 9/3014* (2013.01); *B30B 9/3057* (2013.01); *B30B 15/007* (2013.01); *B30B 15/32* (2013.01)

(58) Field of Classification Search

CPC ..... B30B 1/34; B30B 1/36; B30B 9/3007; B30B 9/3025; B30B 9/3014; B30B 9/3057; B30B 11/265; B30B 11/225; B30B 15/24; B30B 15/245; B30B 15/007; B30B 15/32

See application file for complete search history.

(56) References Cited

U.S. PATENT DOCUMENTS 3,523,443 A * 8/1970 Herbert ..... B30B 1/34 100/214
4,646,633 A * 3/1987 Falguieres ..... B30B 9/062 100/116
4,729,301 A * 3/1988 Smith ..... B30B 9/3007 100/215

(Continued)

FOREIGN PATENT DOCUMENTS

DE 37 34 555 A1 4/1989
DE 195 28 813 A1 2/1997

(Continued)

OTHER PUBLICATIONS

Translation of DE 20 2006 007 759 U1, Strautmann, 5 pages.*
Extended European Search Report dated Oct. 2, 2015 in EP 15166287.1 with English translation of relevant parts.

*Primary Examiner* — Jimmy T Nguyen
(74) *Attorney, Agent, or Firm* — Collard & Roe, P.C.

(57) ABSTRACT

A baling press has a horizontal construction, for compaction of loose material, a pressing channel having a fill-in opening, a pressing plate that can be displaced in the pressing channel, a pressing surface that stands in contact with the material to be compacted, multiple hydraulic cylinders coupled with electro-hydraulic drive assemblies for generating a pressing force, for advancing the pressing plate for the purpose of introducing the pressing force into the filled-in material, as well as for returning the pressing plate to a starting position, and a control and regulation system configured for monitoring the spatial orientation of the pressing surface and keeping it constant during the advancing movement of the pressing plate.

9 Claims, 11 Drawing Sheets

(56) References Cited

U.S. PATENT DOCUMENTS

| | | | | |
|---|---|---|---|---|
| 4,953,458 | A * | 9/1990 | Day | B30B 1/323<br>100/214 |
| 6,941,783 | B2 * | 9/2005 | Yamanaka | B30B 15/16<br>100/269.14 |
| 2005/0257697 | A1 * | 11/2005 | Futamura | B30B 1/18<br>100/46 |
| 2008/0098908 | A1 * | 5/2008 | Song | B21J 9/16<br>100/218 |

FOREIGN PATENT DOCUMENTS

| | | | | |
|---|---|---|---|---|
| DE | 202006007759 | U1 * | 7/2006 | B30B 9/3025 |
| DE | 10 2009 053 134 | B4 | 5/2011 | |

* cited by examiner

BALING PRESS

CROSS REFERENCE TO RELATED APPLICATIONS

Applicant claims priority under 35 U.S.C. § 119 of German Application No. 10 2014 106 181.0 filed on May 4, 2014, the disclosure of which is incorporated by reference.

BACKGROUND OF THE INVENTION

1. Field of the Invention

The invention relates to a baling press, especially to a baling press having a horizontally movable pressing plate, for compaction of loose material, for example of paper, cardboard packaging, plastic waste, PET bottles and metal cans, and similar waste. The baling press comprises a housing and a pressing channel having a fill-in opening for the loose material, a pressing plate that can be displaced in the pressing channel over a predetermined pressing path length, and an electro-hydraulic device for generating a pressing force and for displacing the pressing plate for the purpose of transferring the pressing force to the filled-in material.

2. Description of the Related Art

Baling presses having a horizontally movable pressing plate are known. They are used to predominantly compact packaging material made from paperboard and cardboard, but also cut material from document shredders, plastic waste, PET bottles, and textile fiber material, in order to be able to transport this material, temporarily store it, and pass it on to recycling as a recyclable material.

Different constructions of horizontally functioning baling presses are common, including horizontal channel baling presses and horizontal counter-plate baling presses, among which the object of the present patent should also be classified. In this connection, the material filled into the pressing channel, which is also called a pressing box in the case of counter-plate presses, is pushed through the fill-in region into a pressing space by means of a pressing plate that can be displaced in the horizontal direction and is preferably driven electro-hydraulically, and there the material is compacted to form bales, which generally have a block shape, under the effect of the pressing force.

A problem in baling presses of this type consists in that because of the non-homogeneous strength properties of the material to be compacted, counter-forces act on the pressing plate during the pressing process, which forces vary in terms of time and place. This has the result that the spatial orientation of the pressing plate changes in relation to the pressing direction, if the pressing plate is not held and guided in sufficiently stable manner. If mechanical holders and guides that are structured in robust manner are subject to significant wear because of constant changes in stress, which wear leads to failures in operation or at least requires costly and complicated preventive maintenance and repair measures.

In DE 37 34 555 A1, a baling press is described, in which a press punch is coupled with a drive that consists of two or more cylinders disposed axis-parallel next to one another, which cylinders preferably have the same diameter, of which one cylinder or a group of cylinders is supported in locally fixed manner and displaces a yoke together with the press punch. A further cylinder or a group of further cylinders is supported on the yoke and displaces the press punch. Yoke and press punch are guided mechanically, by means of support bearings, within a press housing. The first cylinder or the first group of multiple cylinders serves to compact the material to form bales; the further cylinder or the group of further cylinders serves to push the finished, compacted bale out.

The terms pressing plate and press punch are considered synonymous in the sense of the invention.

DE 10 2009 053 134 B4 also describes a baling press for compaction of cardboard packaging and similar waste products to form block-shaped bales. The drive device for the press punch comprises two groups of axis-parallel cylinders, of which a first group, supported on the press housing, is provided for displacement of a carriage together with the press punch, over a first partial distance of the pressing path, and the second group, supported on the carriage, is provided for displacement of the press punch over a second partial distance of the pressing path. A further cylinder, supported on the press punch, serves to push the finished, compacted bale out. Carriage and press punch are mechanically guided within the press housing.

SUMMARY OF THE INVENTION

Proceeding from this state of the art, the invention is based on the task of further developing a baling press of the previously described type in such a manner that the stability of the orientation of the press punch or of the pressing plate is guaranteed independent, to the greatest possible extent, of mechanical holders or guides.

According to the invention, in a baling press of the type described initially, namely comprising

- a pressing channel or pressing box having a fill-in opening for the loose material,
- a pressing plate that can be displaced in the pressing channel over a predetermined pressing path length $L_{ges}$, which plate has a pressing surface that stands in contact with the material to be compacted, as well as
- multiple hydraulic cylinders coupled with electro-hydraulic drive assemblies,
  - for generating a pressing force,
  - for advancing the pressing plate over the predetermined pressing path length $L_{ges}$ for the purpose of introducing the pressing force into the filled-in material, and
  - for returning the pressing plate to a starting position,
- a control and regulation system is provided, which is configured for monitoring the spatial orientation of the pressing surface and keeping it constant during the advancing movement of the pressing plate over the entire pressing path length $L_{ges}$.

In a first, preferred embodiment of the baling press according to the invention, the control and regulation system has

- a distance measurement device for sequential measurement of the actual distances between at least three collinear measurement points on the pressing surface, which is moving, and reference points fixed on the frame, which define the desired orientation of the pressing surface,
- a measurement result evaluation unit for determining deviations of the actual distances from predetermined desired distances, and
- a control circuit connected with the drive assemblies, for variation of the drive output for the purpose of equalizing differences between actual and desired distances by means of the hydraulic cylinders, in real time.

Measurement of the distances between the measurement points and the reference points is preferably provided optically by means of running-time measurement, laser triangular or evaluation of the phase position of reflected laser radiation. However, a distance measurement by means of potentiometers, using magnetic sensors, pneumatic length measurement or on the basis of eddy current measurements also lies within the scope of the invention.

In another embodiment of the baling press according to the invention, a control and regulation system is provided, in which the electro-hydraulic drives and the assigned hydraulic cylinders, for the purpose of compensating differences of the counter-forces that act on the individual hydraulic cylinders during compaction, are linked with one another by way of a synchronized control system and/or by way of a position regulation system, so that the orientation of the pressing plate, particularly of its pressing surface, is constant relative to the pressing direction, during displacement over the entire pressing path length $L_{ges}$.

In the synchronization control system, for example, it is provided that the spatial orientation of the pressing plate is kept constant on the basis of measurements of the counter-forces that act on the pressing plate at the articulation position of the piston rods. Pressure regulation in the hydraulic circuits takes place as a function of the measurement results, for the purpose of avoiding advancing differences and thereby tilting of the pressing plate.

In the position regulation system, for example, keeping the spatial orientation of the pressing constant is provided on the basis of path measurements at the piston rods of the hydraulic cylinders and pressure regulations in the hydraulic circuits as a function of the results of the path measurements, in such a manner that position errors are regulated out. In this connection, one of the hydraulic cylinders can take on a master function with regard to the advance per time unit, while the other hydraulic cylinders are assigned a slave function.

Preferably, according to the invention, in the embodiments of the control and regulation system, a separate drive assembly is assigned to each hydraulic cylinder, particularly to a group of hydraulic cylinders, and each drive assembly has a hydraulic pump and a frequency inverter.

Furthermore, the hydraulic cylinders are preferably switched in parallel, by groups, wherein a first group of hydraulic cylinders switched in parallel is preferably provided for generating and transferring the pressing force to a displaceable intermediate plate. The intermediate plate can be displaced by a first partial pressing path length $L_1$, together with the pressing plate. A second group of hydraulic cylinders switched in parallel is preferably provided for generating and transferring the pressing force to the pressing plate, wherein the pressing plate can be displaced by a second partial pressing path length $L_2$ relative to the intermediate plate. It holds true that the first partial pressing path length $L_1$ plus the second partial pressing path length $L_2$ are equal to the pressing path length $L_{ges}$.

After having been displaced by the first partial pressing path length $L_1$, the intermediate plate is fixed in place in its position as a result of the force generated by the first group of hydraulic cylinders, so that the second group can be supported by the intermediate plate for the purpose of advancing the pressing plate alone.

The hydraulic cylinders of the first group are preferably disposed to press or push the intermediate plate, including the pressing plate, in the pressing direction, and the hydraulic cylinders of the second group are also disposed to press or push the pressing plate in the pressing direction. However, embodiments in which the hydraulic cylinders of the first group pull the intermediate plate, including the pressing plate, in the pressing direction and/or in which the hydraulic cylinders of the second group pull the pressing plate in the pressing direction also lie within the scope of the invention.

The first group of hydraulic cylinders can comprise four hydraulic cylinders switched in parallel, for example, while the second group comprises three hydraulic cylinders switched in parallel.

According to another embodiment variant, the first group of hydraulic cylinders comprises three hydraulic cylinders switched in parallel, while the second group of hydraulic cylinders comprises four hydraulic cylinders switched in parallel.

In a further embodiment variant, the same number of hydraulic cylinders is provided in the first group of hydraulic cylinders and in the second group of hydraulic cylinders; according to the invention, however, the first group of hydraulic cylinders should have at least three hydraulic cylinders switched in parallel, and the second group of hydraulic cylinders should also have at least three hydraulic cylinders switched in parallel.

A further hydraulic cylinder connected with the pressing plate can be present, configured for pushing a bale that has been completely pressed out of the pressing channel after the pressing path length $L_{ges}$ has been reached, preferably in the case of a horizontal baling press in an embodiment as what is called a pressing-box press. In this type of baling press, the output-side opening of the pressing channel is closed off with a sliding or pivoting door for the pressing process. The closed and locked door has the function of a counter-plate in the pressing process.

BRIEF DESCRIPTION OF THE DRAWINGS

In the following, the invention will be explained in greater detail using exemplary embodiments that do not, however, restrict the invention. In the related drawings, the figures show, in schematic representations.

DETAILED DESCRIPTION OF THE PREFERRED EMBODIMENTS

Figure 1:
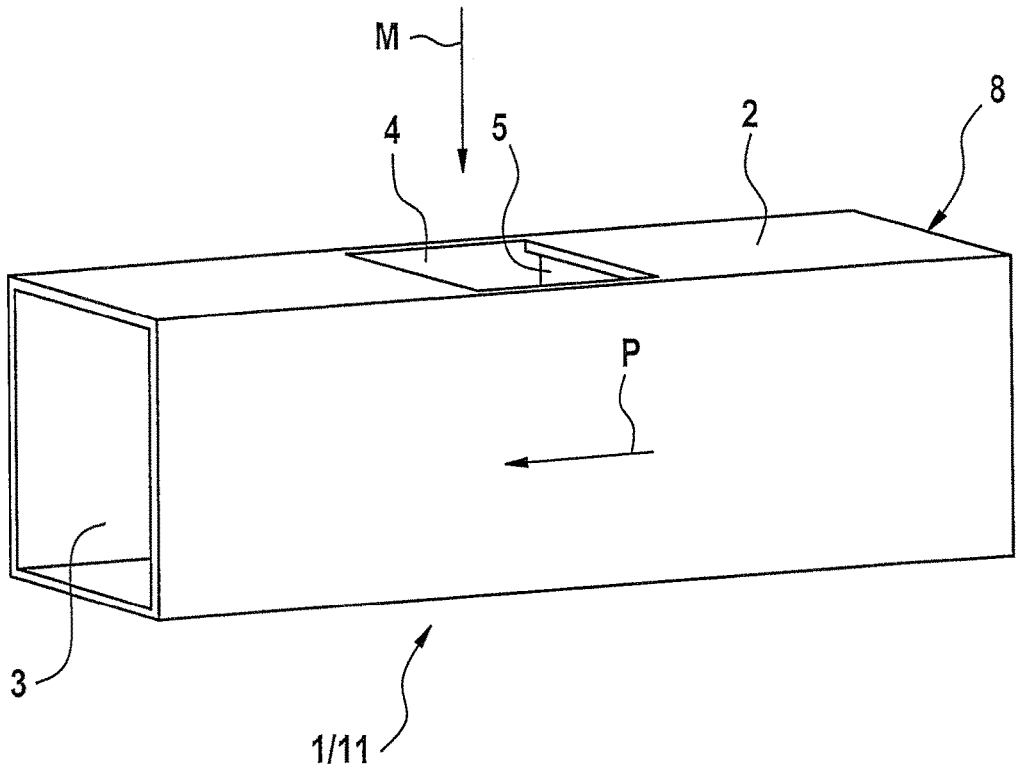
FIG. 1 the simplified perspective representation of a baling press having a horizontally displaceable pressing plate, according to the state of the art, with a viewing direction from the side, onto the pressing channel with fill-in opening and onto the pressing plate, here in its starting position before the start of the pressing process, in an embodiment as a channel baling press.

From FIG. 1, the fundamental structure of a horizontally functioning baling press 1, in the embodiment as a channel baling press 11, according to the state of the art, is evident. A view from the side, from the outside, onto the press housing 2, which encloses the pressing channel 3, among other things, is shown in perspective. The press housing 2 has a fill-in opening 4, through which the material M to be compacted (not shown here) can be filled into the pressing channel 3, in the fill-in direction according to the arrow. In the interior of the pressing channel 3, the pressing plate 5, which is partially visible here, is situated in its starting position; it can be displaced in the pressing direction P and brought back into its starting position again.

Figure 2:
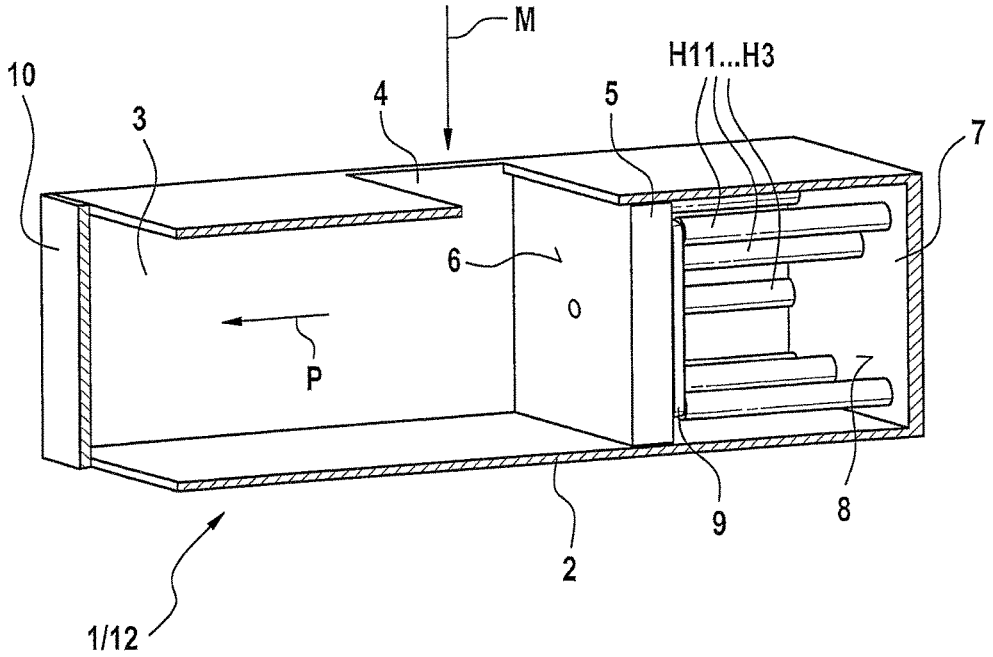
FIG. 2 the perspective representation of a horizontally functioning baling press according to FIG. 1, here in an embodiment as a pressing-box baling press, with the same viewing direction, but with a view into the interior of the press housing and placement of the hydraulic cylinders according to the invention.

For the purpose of a supplemental explanation of the drive of the pressing plate 5 of the channel baling press 11 according to FIG. 1, FIG. 2 shows a view into the interior of the press housing 2, which is shown open on the side, of a horizontally functioning baling press, which is structured as a horizontal baling press of the second construction here in FIG. 2, specifically as a pressing-box baling press 12. Here, the pressing channel 3, the fill-in opening 4, and the pressing plate 5 can be seen, the latter in its starting position at the beginning of the pressing process. The pressing plate 5 is oriented with its pressing surface 6 perpendicular to the pressing direction P. Therefore the pressing surface 6 is also disposed at a right angle to every section of the inner surfaces of the pressing channel 3, along which the pressing plate moves back and forth during a pressing stroke.

The pressing channel 3 has a square or rectangular cross-section, for example, which the pressing plate 5 essentially fills because of its geometrical shaping, wherein the thickness of the pressing plate 5 extends in the pressing direction P. A space 7 that faces away from the pressing channel 3, which space extends from the pressing plate 5 all the way to a wall 8 that closes off the press housing 2 opposite to the pressing direction P, is reserved for an electro-hydraulic device that is configured for generating a pressing force and for displacing the pressing plate 5 for the purpose of transferring the pressing force to the fill-in material M. The electro-hydraulic device has multiple hydraulic cylinders H11, H12 . . . H1*n* as well as H21, H22 . . . H2*n* (where n>2), which are switched in parallel, by groups, in part, according to the invention (see FIG. 3 to FIG. 10).

Particularly in the embodiment of the horizontal baling press as a pressing-box baling press 12, in other words a horizontal baling press 1 having a counter-plate 10 at the exit of the pressing channel 3, an additional hydraulic cylinder H3 is provided, the function of which will still be explained later.

Differential cylinders, for example, which consist essentially of housing, piston, piston rod, and connectors for a pressure medium, are used as hydraulic cylinders H11, H12 . . . H1*n*; H21, H22 . . . H2*n*; H3, wherein the piston rod is situated only on one side of the piston surface in the case of differential cylinders.

Figure 10:
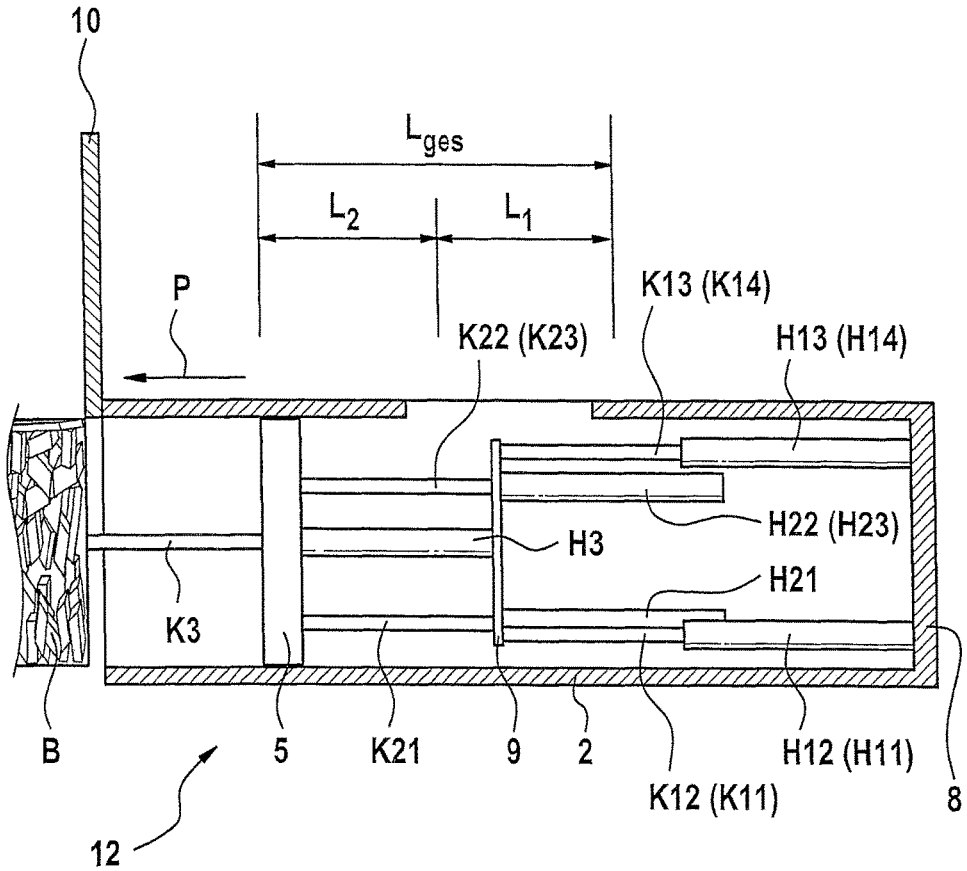
FIG. 10 the pressing-box baling press according to FIG. 8 in a non-perspective side view, in which the finished, pressed bale is being ejected.

A wall 10 that closes off the pressing channel 3 in the pressing direction P—which wall is also referred to as a counter-plate or door 10—absorbs the pressing force during the pressing process and is temporarily removed after completion of the pressing process, in other words pushed aside or pivoted away, so that the finished, pressed bale can be pushed out through this end of the pressing channel 3, which is now open (see FIG. 10).

Figure 3:
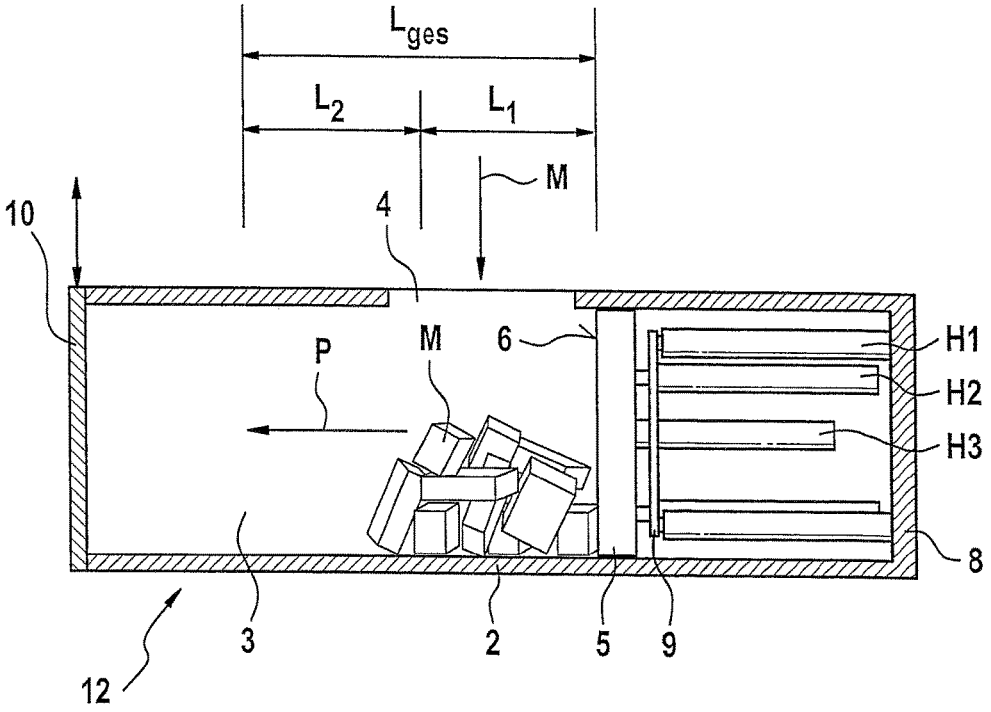
FIG. 3 the pressing-box baling press according to FIG. 2 in a non-perspective side view, with representation of the pressing path length from the starting position of the pressing plate all the way to its position with a finished, pressed bale.

A variant of the grouped arrangement of hydraulic cylinders H11, H12 . . . H1*n*; H21, H22 . . . H2*n* switched in parallel will be explained below using FIG. 3. This grouped arrangement, according to the invention, of these hydraulic cylinders is shown in FIG. 3 in the case of a pressing-box baling press 12. This grouped arrangement, according to the invention, of these hydraulic cylinders can also be used in the case of horizontal baling presses in an embodiment as channel baling presses 11, according to the invention.

In FIG. 3, a pressing path length $L_{ges}$ is shown as an example, by which length the pressing plate 5 is to be advanced in the pressing direction P, for the purpose of compaction of the material M filled into the pressing channel 3 to form bales.

A first group H1 of hydraulic cylinders H11, H12 . . . H1*n* switched in parallel is provided for generating the pressing force and transferring it to an intermediate plate 9, which is disposed to be displaceable in the pressing direction P, together with the pressing plate 5. For this purpose, the hydraulic cylinders H11, H12 . . . H1*n* are each supported on the wall 8—the rear wall—of the press housing 2 with their housing, for example, while the piston rods are connected with the intermediate plate 9. When the piston rods of the hydraulic cylinders H11, H12 . . . H1*n* are moved out, the intermediate plate 9 is fixed in place in the position at the end of the first partial pressing path length $L_1$; see also, in this regard, FIG. 6.

The hydraulic cylinders H21, H22 . . . H2*n*, switched in parallel, of a second group, are also provided for generating the pressing force and for transferring it to the pressing plate 5, wherein these hydraulic cylinders H21, H22 . . . H2*n* are attached to/supported on the intermediate plate 9 with their housings, while the piston rods are connected with the pressing plate 5. Therefore the pressing plate 5 can be displaced relative to the fixed intermediate plate 9 by means of hydraulic cylinders H21, H22 . . . H2*n*, see FIG. 8 in this regard.

During operation according to the state of the art of such an arrangement, the displacement of the intermediate plate 9 together with the pressing plate 5 by means of the hydraulic cylinders H11, H12 . . . H1*n* is at first provided along a first partial pressing path length $L_1$, and only afterward does the displacement of the pressing plate 5 by means of the hydraulic cylinders H21, H22 . . . H2*n* along a second partial pressing path length $L_2$ take place. The sum of first partial pressing path length $L_1$ and second partial pressing path length $L_2$ corresponds to the total pressing path length $L_{ges}$.

In this connection, the problem already described initially exists, that during advancing of the pressing plate 5 by means of the hydraulic cylinders H11, H12 . . . H1*n*; H21, H22 . . . H2*n*, the spatial orientation of the pressing plate 5 with reference to the pressing direction P, particularly its orientation relative to the sections of the inner surfaces of the pressing channel 3 in question, can change, which would have the result of wedging of the pressing plate 5 in the pressing channel 3 and therefore of an interruption in the operation of the baling press 1. The reason for this lies, as has already been described, in the non-homogeneous strength properties of the material M to be compacted, causing counter-forces to act against the pressing plate 5, which forces vary in terms of time and—with reference to the pressing surface 6—in terms of place.

Figure 6:
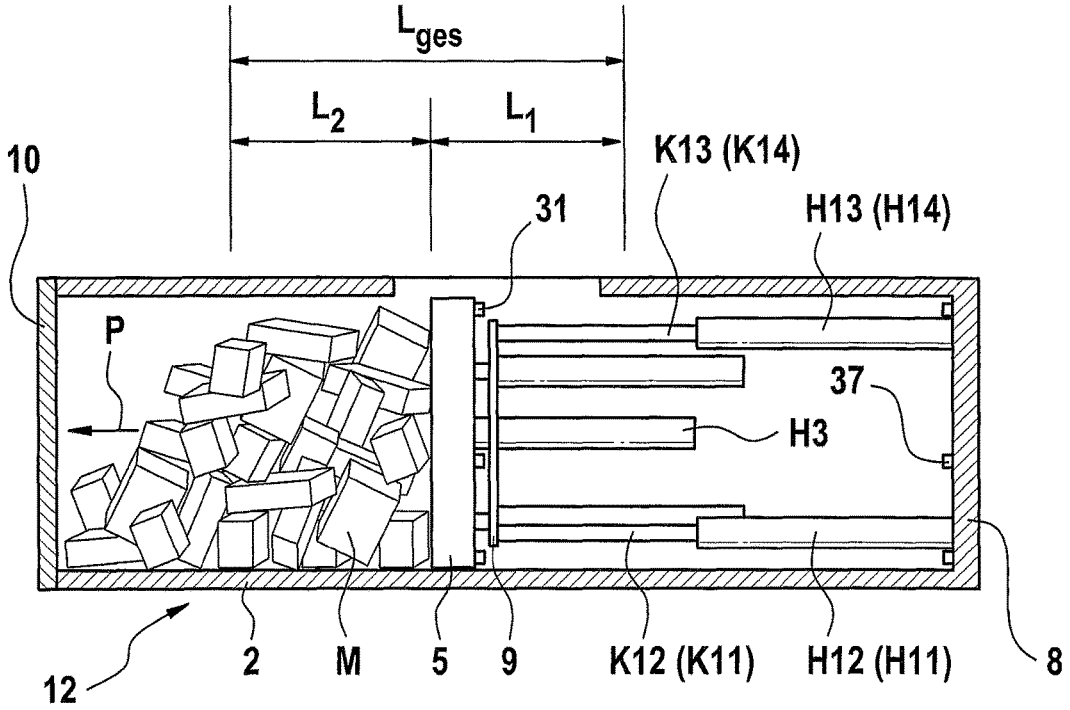
FIG. 6 the horizontally functioning pressing-box baling press according to FIG. 3 in a non-perspective side view and the piston rods of the hydraulic cylinders of the first group of a channel baling press having been moved out.

In order to avoid or at least reduce the great effort and expense for mechanical guides of the pressing plate 5 and/or of the intermediate plate 9 that have been usual until now for the purpose of stabilizing the pressing plate orientation in the pressing channel 3, a control and regulation system is provided, according to one aspect of the invention, having a distance measurement device 30 for sequential measurement of the actual distances between at least three collinear measurement points 31, 32, 33 on the pressing surface 6 or the pressing plate 5, which is being displaced, and reference points 35, 36, 37 fixed in place on the frame, which are part of a reference surface and thereby define the desired orientation of the pressing surface. An exemplary arrangement of these measurement points 31, 32, 33 and reference points 35, 36, 37 on a baling press according to the invention is shown in FIG. 6. For the sake of clarity of this FIG. 6, only the reference symbols 31 and 37 were entered. The position of the further measurement points and reference points can be seen in this figure, but the related reference numbers 32, 33 and 36, 37 are then entered in FIG. 12.

Figure 12:
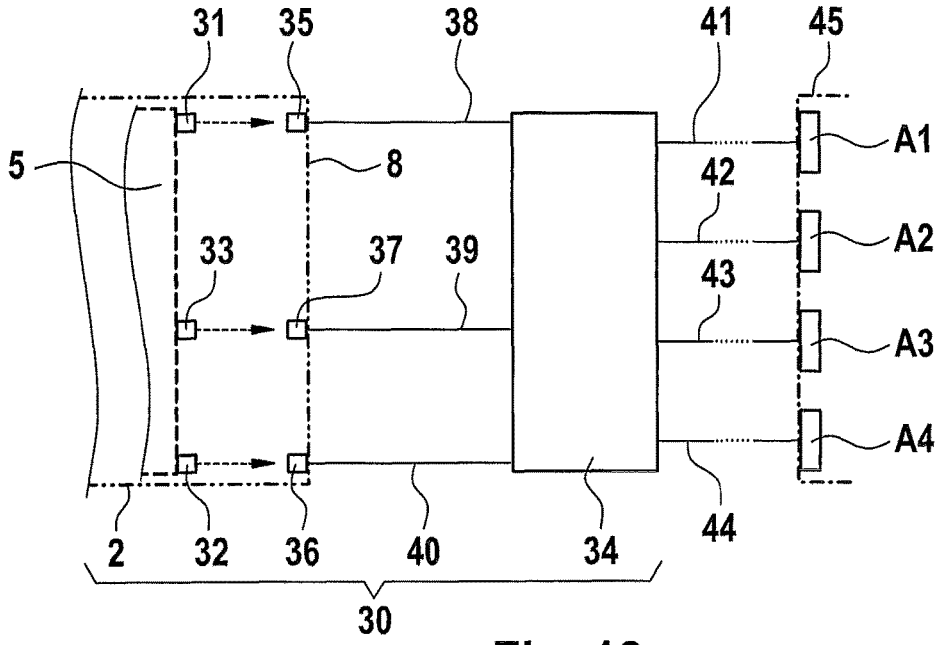

Furthermore, evaluation of the measurement result for determining deviations of the actual distances from predetermined desired distances is provided in an evaluation unit 34 and a control circuit, connected with the drive assemblies A1, A2, A3, A4 by way of signal lines 41, 42, 43, 44, for variation of the drive output for the purpose of equalizing differences between actual distances and desired distances by means of the hydraulic cylinders, in real time, as shown schematically in FIG. 12. The reference points 35, 36, 37 are connected with the evaluation unit 34 by means of a signal line 38, 39, 40, respectively.

Measuring the distances between the measurement points and the reference points preferably takes place optically by means of running-time measurement, laser triangulation or evaluation of the phase position of reflected laser radiation.

It is advantageous if a separate drive assembly A1, A2 . . . An is assigned to each of the hydraulic cylinders H11, H12 . . . H1*n* or H21, H22 . . . H2*n*, for separate control (see FIG. 11). Each of the drive assemblies A1, A2 . . . An has a hydraulic pump (without a reference symbol), as well as, preferably, a frequency inverter (without a reference symbol). If the counter-forces that act on the pressing plate 5 in differentiated manner during the pressing process cause deviations of the measurement results from the predetermined desired values, these deviations are equalized in that a change in the drive output is caused by means of controlling the respective drive assembly A1, A2 . . . An, for example by changing the pressure or volume stream in the corresponding hydraulic circuit, for the purpose of regulating the differences out in real time, so that the orientation of the pressing plate 5 relative to the pressing direction P and with reference to the sections of the inner surfaces of the pressing channel 3 in question is maintained.

Figure 4:
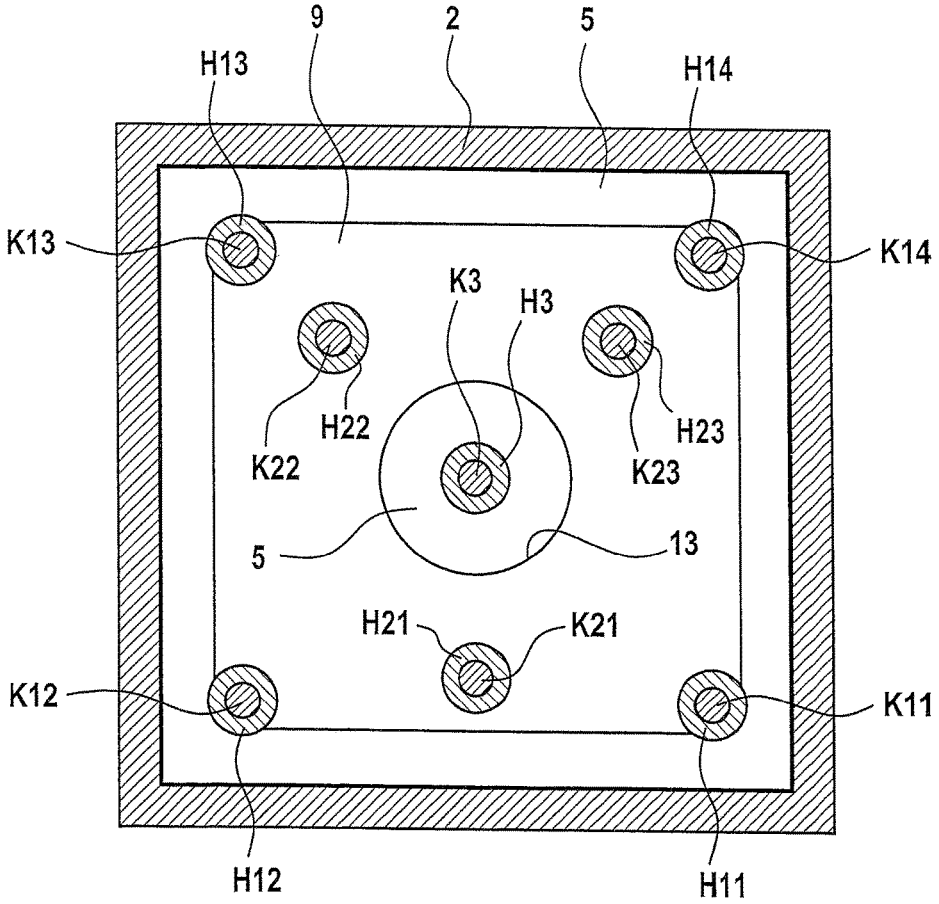
FIG. 4 a view from the rear wall of the baling press according to FIG. 2 onto the rear side of the pressing plate and the intermediate plate inserted behind it, lying opposite to the pressing direction, and representation of a first group of hydraulic cylinders switched in parallel to the pressing plate and a second group of hydraulic cylinders switched in parallel to the intermediate plate.

In FIG. 4, the view of the observer proceeds from the rear wall 8 of the baling press 11 or 12 according to FIG. 2 or 3, respectively, to the pressing plate 5 and to the intermediate plate 9 that lies behind it opposite to the pressing direction P, in front of it in the figure.

Using a schematic sectional representation, the number and coupling, particularly the spatial position of the piston rods K11, K12, K13, K14 of four hydraulic cylinders H11, H12, H13, H14, as an example, of the first group H1, and of the piston rods K21, 22, 23 of three hydraulic cylinders H21, H22, and H23, as an example, of the second group H2 are shown symbolically here. A centrically disposed piston rod K3 of a single hydraulic cylinder H3 is provided for pushing the finished, pressed bale out of the pressing channel 3 in the extended pressing direction P. The hydraulic cylinder H3 is attached to the pressing plate 5, and a recess 13 is provided in the intermediate plate 9, through which recess the hydraulic cylinder H3 reaches at some points in time (see FIG. 3 or FIGS. 6 to 9).

Figure 5:
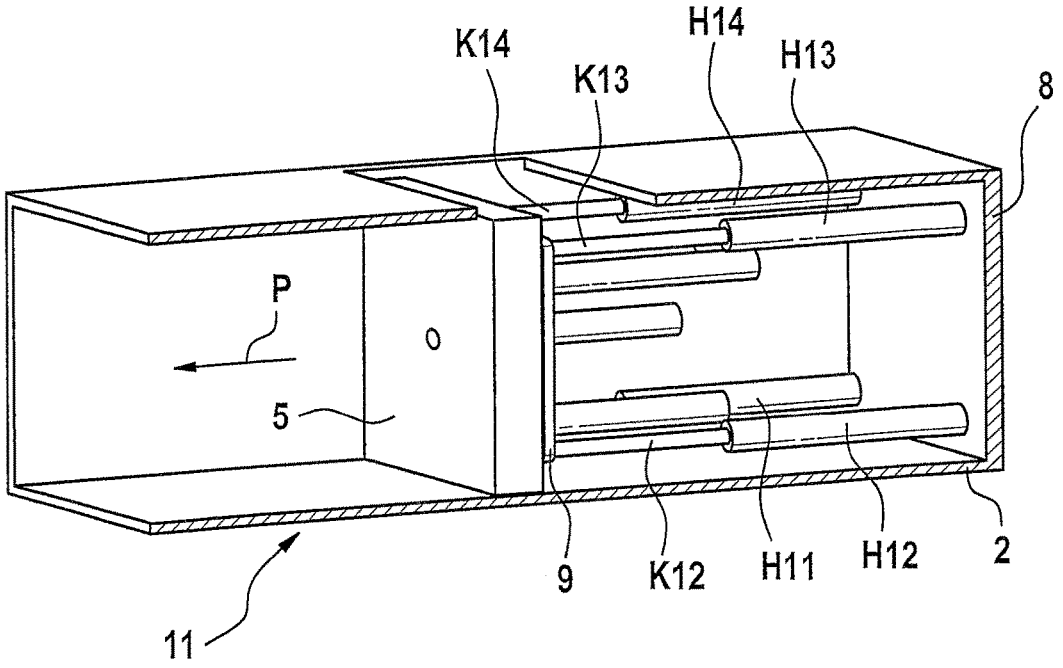
FIG. 5 the perspective representation of a baling press in an embodiment as a channel baling press according to FIG. 1, however with placement of the drive elements according to the invention in accordance with FIG. 2, but here with the piston rods of the hydraulic cylinders of the first group having been moved out.

FIG. 5 shows, as FIG. 2 already did, a view, in perspective, into the interior of the press housing 2, shown open on the side, of a horizontally functioning baling press, here of a channel baling press 11. While in FIG. 2, the starting position of the pressing plate 5 at the beginning of the pressing process can be seen, FIG. 5 illustrates the constellation that results after the piston rods K11, K12, K13, K14 of the hydraulic cylinders H11, H12, H13, H14 of the first group H1 have been moved out and the intermediate plate 9, together with the pressing plate 5, has been advanced over the first partial pressing path length $L_1$ into the position shown, wherein the material situated in the pressing channel 3 has been pre-compacted in the diminishing volume of the pressing channel 3, see FIG. 6 in this regard.

During advancing, it was ensured, by means of the control and regulation system described above, that advancing differences of the hydraulic cylinders H11, H12, H13, H14, which are switched in parallel, were regulated out by means of variation of the individual drive outputs, so that the orientation of the intermediate plate 9 and also of the pressing plate 5, relative to the pressing direction P and to the inner surfaces of the pressing channel 3, has remained constant during displacement over the partial pressing path length $L_1$.

The intermediate plate 9 is fixed in place in the position shown, after having been advanced by the first partial pressing path length $L_1$, for example by means of being pressed against stop elements (not shown) or by means of what is called hydraulic locking of the hydraulic cylinders in question, which is known.

In FIG. 6, the constellation described above is shown using a non-perspective, open side view of a pressing-box baling press 12. As is evident here, the intermediate plate 9, together with the pressing plate 5, has been advanced over the first partial pressing path length $L_1$ into the position shown, wherein the material "M" situated in the pressing channel 3 has been pre-compacted but not yet compacted to form a finished bale.

Figure 7:
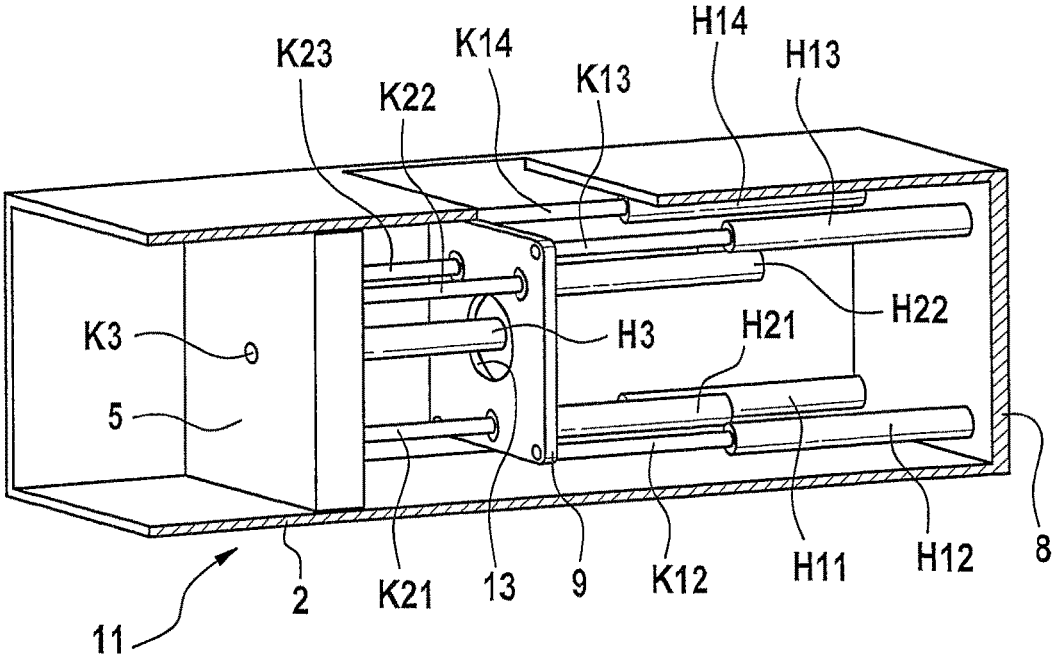
FIG. 7 the perspective representation according to FIG. 5, but here with the piston rods of the hydraulic cylinders of the second group having been additionally moved out, wherein the pressing plate is situated in its position with a finished, pressed bale.

As FIG. 2 and FIG. 5 already did, FIG. 7 also shows a view, in perspective, into the interior of the press housing 2, shown open on the side—here of a channel baling press 11 —, wherein here, however, the piston rods K21, K22, K23 of the hydraulic cylinders H21, H22, H23 of the second group are moved out, and the pressing plate 5 has been advanced over the second partial pressing path length $L_2$ into the position shown, the end pressing position, while the intermediate plate 9 has remained in its fixed position according to FIG. 5 and FIG. 6. In this connection, the material "M" situated in the pressing channel 3 was compacted to form a finished bale "B" (not shown in FIG. 7), as the result of the diminishing volume of the pressing channel 3.

During this advancing, as well, the control and regulation system provided according to the invention has ensured that advancing path differences of the hydraulic cylinders H21, H22, H23 that are switched in parallel have been regulated out, so that the orientation of the pressing plate 5 relative to the pressing direction P and to the inner surfaces of the pressing channel 3 has remained constant during its displacement over the second partial pressing path length $L_2$.

Figure 8:
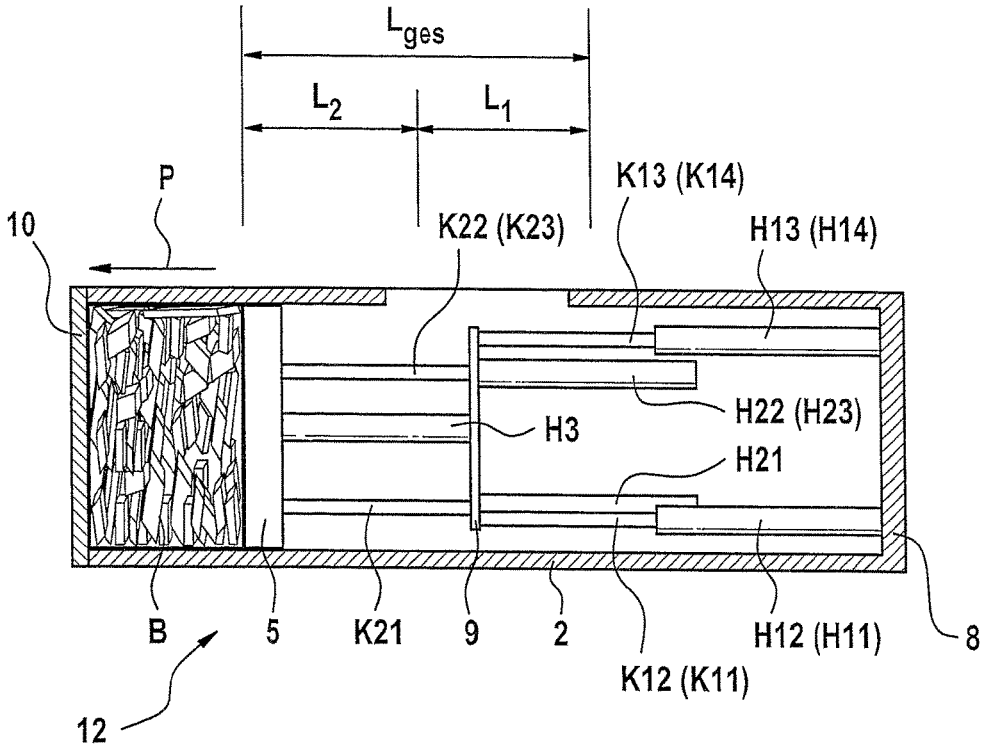
FIG. 8 the pressing-box baling press according to FIG. 6 in a non-perspective side view, in which the pressing plate is situated in its position with a finished, pressed bale.

In FIG. 8, the constellation described using FIG. 7 is shown in a non-perspective side view, here in the case of a pressing-box baling press 12. As is evident, the pressing plate 5 has been advanced over the second partial pressing path length $L_2$, into the position shown, the end pressing position, wherein the material "M" present in the pressing channel 3 was pressed to form a finished bale "B". In this process step, the intermediate plate 9 has remained in its fixed position according to FIG. 5 and FIG. 6.

In accordance with an advantageous embodiment of the baling press 1 according to the invention, a further hydraulic cylinder H3, which is provided for pushing the finished, pressed bale out of the pressing channel 3, is provided in addition to the four hydraulic cylinders H11, H12, H13, H14 of the first group and the three hydraulic cylinders H21, H22, H23 of the second group, preferably in its use in a pressing-box baling press 12. The hydraulic cylinder H3 is connected with the pressing plate 5 with its housing, fixed on the frame, while its piston rod K3 is passed through the pressing plate 5. In the constellation shown here, the piston rod K3 has not yet been moved out, and therefore the bale is still situated within the pressing channel 3, directly in front of the pressing plate 5.

Figure 9:
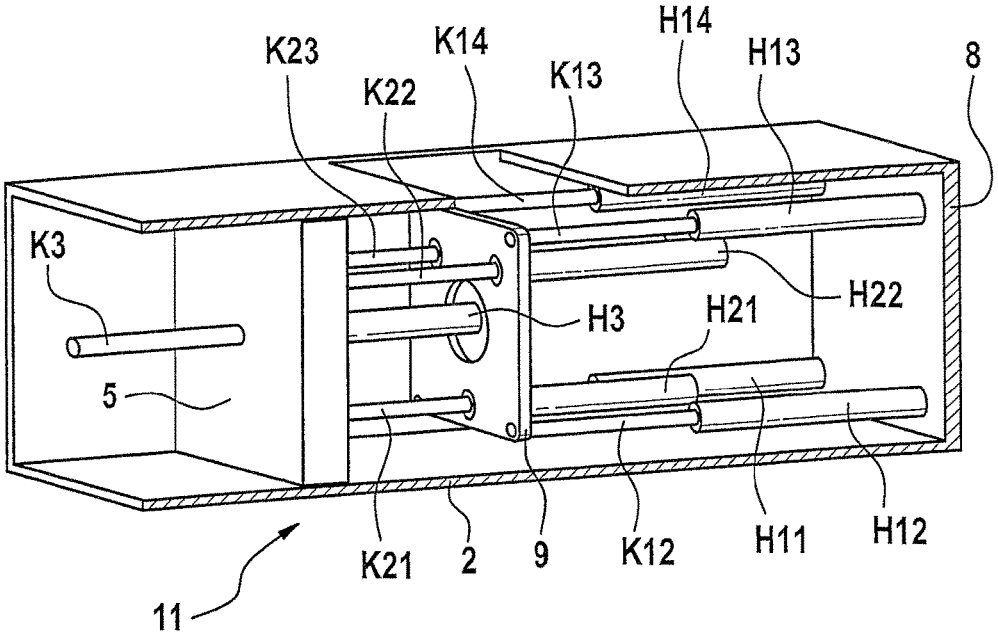
FIG. 9 the perspective representation of a channel baling press according to FIG. 5, but here with the piston rod of an additional hydraulic cylinder for pushing the last, finished, pressed bale of a pressing series out of the pressing channel having been moved out.

In contrast, FIG. 9 shows the situation with the piston rod K3 moved out, when used in a channel baling press 11.

Specifically, the piston rod K3 has been moved out so far that the bale can be pushed out of the pressing channel 3. This is only necessary, in the case of a channel baling press 11, if its pressing channel 3 must be clear, in other words empty, for example due to maintenance work.

In FIG. 10, the constellation described using FIG. 8 is shown in a non-perspective side view, in a pressing-box baling press 12. A work cycle of the baling press, which can consist of multiple pressing strokes for the purpose of compaction of the material M, is concluded, after a bale "B" has been completely pressed and tied up and ejected, in that the piston rods K11, K12, K13, K14 of the hydraulic cylinders H11, H12, H13, H14 of the first group, the piston rods K21, K22, K23 of the hydraulic cylinders H21, H22, H23 of the second group, and the piston rod K3 of the hydraulic cylinder H3 have been moved in again, and thereby the piston rod K3, the intermediate plate 9, as well as the pressing plate 5 are moved back into their starting positions.

While the hydraulic cylinders H11, H12, H13, H14 and H21, H22, H23, H3 are controlled in groups, one after the other, to move out the piston rods K11, K12, K13, K14 and K21, K22, K23 and K3, in accordance with the work steps according to FIG. 1 to FIG. 10, moving in the piston rods K11, K12, K13, K14, K21, K22, K23, K3 can optionally be provided either one after the other, in terms of time, or at the same time.

Figure 11:
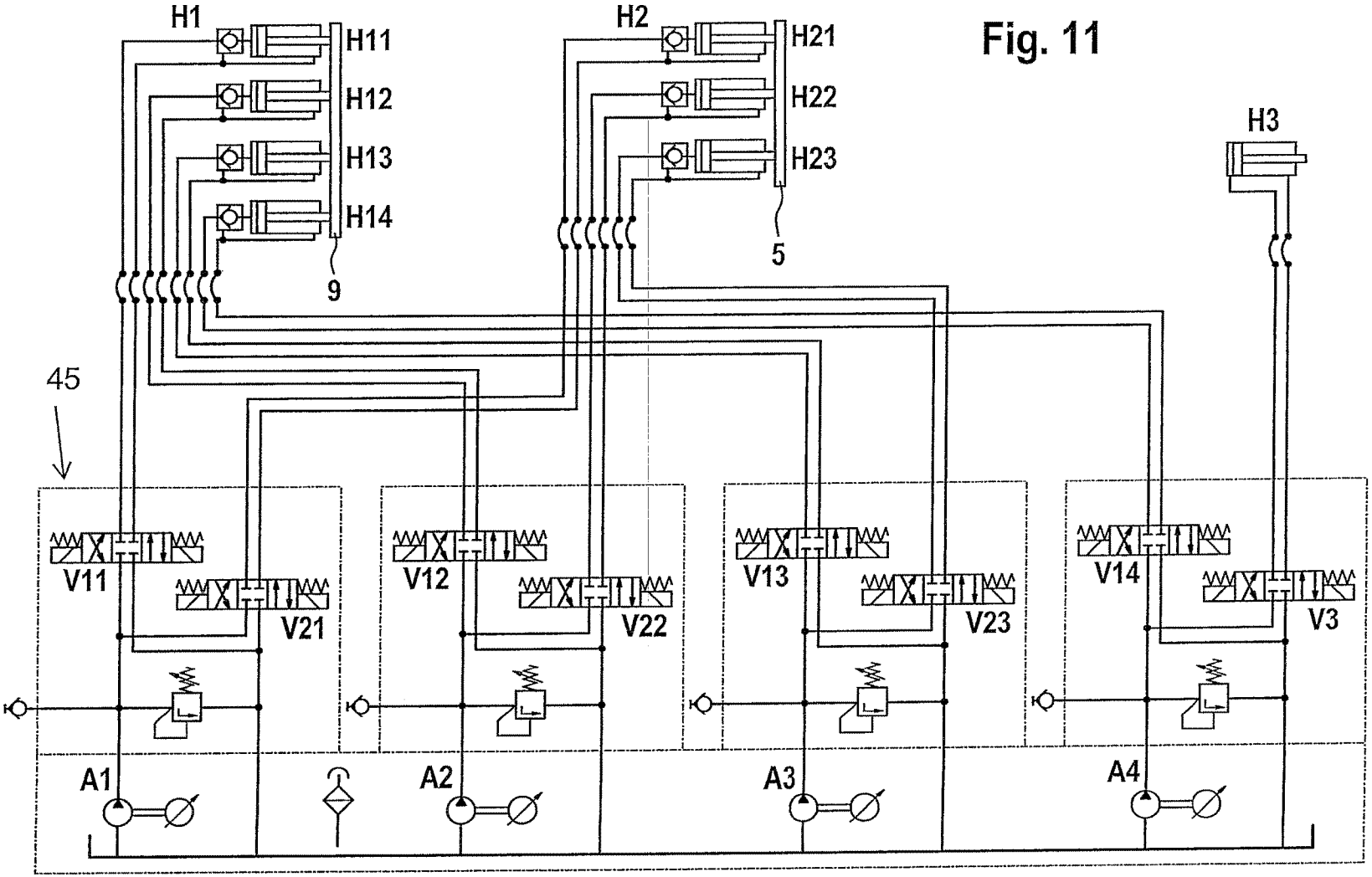
FIG. 11 the example of a hydraulic circuit diagram according to the invention for operation of baling presses according to FIG. 2 to FIG. 10 with individual control of the hydraulic cylinders, and FIG. 12 an example of the placement of the components of the control and regulation system according to the invention, in a baling press according to the invention, having a horizontal construction.

Using the example of a hydraulic circuit diagram, FIG. 11 shows individual control of the hydraulic cylinders H11, H12, H13, H14 and H21, H22, H23, as well as H3, by means of four drive assemblies A1 to A4. As is evident from FIG. 11, a drive assembly A1 is assigned to the hydraulic cylinder H11 and the hydraulic cylinder H21, a drive assembly A2 is assigned to the hydraulic cylinder H12 and the hydraulic cylinder H22, a drive assembly A3 is assigned to the hydraulic cylinder H13 and the hydraulic cylinder H23, and a drive assembly A4 is assigned to the hydraulic cylinder H14 and the hydraulic cylinder H3. 4/3-way valves V11, V21; V12, V22; V13, V23; V14, V3 having a central shut-off position and two through-flow paths for alternate application to the hydraulic cylinders are disposed in the hydraulic lines between the drive assemblies A1 . . . A4 and the related hydraulic cylinders H11 . . . H14; H21 . . . H23; H3, in each instance.

Therefore each of the hydraulic cylinders H11 . . . H14; H21 . . . H23; H3 can be separately and individually controlled by a separately assigned drive assembly A1 . . . A4. The drive assemblies A1 . . . A4, and preferably also the 4/3-way valves V11, V21; V12, V22; V13, V23; V14, V3 are placed, for example, in a hydraulic module 45, which is preferably disposed on the housing 2.

In conclusion, it is being pointed out that terms such as "at the top," "at the bottom," "on the left," and "on the right" in the description relate only to the figures in question, and therefore can deviate from reality. Also, the proportions can deviate from the figures in reality. Furthermore, the drawings are not precise technical drawings, but rather are merely intended to show the nature of the invention. With regard to the reference symbols, it is being noted that the same numbers in the different figures always refer to the same components and have the same meaning, in each instance, even if they are not explicitly mentioned with regard to every figure in the description of the embodiments. The meaning of reference symbols not mentioned in the description is evident from the reference symbol list as a whole and/or from the disclosure in the figures.

The invention is not restricted to the exemplary embodiment shown and described, but rather is variable in the methods and devices used. It particularly also comprises variants that can be formed by means of a combination of characteristics or elements that have been described in connection with the present invention. All of the characteristics mentioned in the above description and disclosed in the drawings are further integral parts of the invention, even if they are not especially emphasized and are not mentioned in the claims. Furthermore, individual characteristics or methods of functioning described in connection with the figures or technical characteristics merely shown in the figures can represent an independent invention, in and of themselves.

According to an embodiment variant not contained in the figures, measurement of the distances between the measurement points and the reference points can take place, instead of with optical means, with means that act acoustically or mechanically, for example with cable sensors. Cable sensors, also called cable-actuated encoders, are compact sensors and are furthermore inexpensive. The position or position change of objects can be determined precisely with them. Core components of a cable sensor are a sensor element (e.g. potentiometer or encoder) and a precision measurement part. The path change is converted to a proportional electric signal using the sensor element. Cable sensors are very maintenance-free, reliable, and can be installed in particularly fast and simple manner.

Further above in the description, the minimum number of hydraulic cylinders provided, according to the invention, in each of the two groups of hydraulic cylinders was already mentioned. Furthermore, possible and advantageous further exemplary embodiments of the number of hydraulic cylinders in the first group of hydraulic cylinders and in the second group of hydraulic cylinders were also described there. In accordance with the parameters provided for such a baling press, such as, for example, the maximal pressing force or the composition of the waste material to be pressed or the size of the housing of the baling press or the maximal size of the bale of waste material to be produced or its maximal weight, the number of hydraulic cylinders disposed in the first group and in the second group can deviate from the exemplary embodiments already mentioned. According to such a further embodiment variant, the first group of hydraulic cylinders contains three hydraulic cylinders switched in parallel and the second group of hydraulic cylinders contains five hydraulic cylinders switched in parallel; further variants with regard to the number of hydraulic cylinders in the individual groups are possible.

The claims filed with the application are therefore merely proposed formulations without prejudice for achieving further patent protection.

REFERENCE SYMBOL LIST

1 baling press (horizontal construction)
2 press housing
3 pressing channel
4 fill-in opening
5 pressing plate
6 pressing surface
7 space
8 wall (rear wall; support surface)
9 intermediate plate
10 door (counter-plate, counter-bearing)
11 channel baling press (baling press having a horizontal construction)
12 pressing-box baling press (baling press having a horizontal construction)
13 recess
30 distance measurement device (e.g. for running-time measurement, optical)
31, 32, 33 measurement points (collinear)
34 evaluation unit (preferably in the control module)
35, 36, 37 reference points (fixed on frame)
38, 39, 40 signal lines (from item 35, 36, 37 to item 34)
41, 42, 43, 44 signal lines (from item 34 to item A1, A2, A3 or A4)
45 hydraulic module
A1 . . . A4 drive assemblies
B bale (in item 11 or 12, bale compacted from the material M)
H1, H2 groups (of hydraulic cylinders H11 . . . H14 or H21 . . . H23)
H11 . . . H14 hydraulic cylinders
H21 . . . H23 hydraulic cylinders
H3 hydraulic cylinder
K11 . . . K14 piston rods
K21 . . . K23 piston rods
K3 piston rod
$L_1$ first partial pressing path length
$L_2$ second partial pressing path length
$L_{ges}$ pressing path length in total
M material
P pressing direction
V11 . . . V14 directional control valves
V21 . . . V23 directional control valves
V3 directional control valve

The invention claimed is:

1. A baling press (1; 11; 12) for compaction of loose material (M) comprising:

a pressing channel (3) having a fill-in opening (4) for the loose material (M), a pressing plate (5) that can be displaced in the pressing channel (3) over a predetermined pressing path length (Lges), multiple hydraulic cylinders (H11 . . . Hn; H21 . . . Hn) coupled with drive assemblies (A1, A2, A3, A4), for generating a pressing force, for advancing the pressing plate (5) over the predetermined pressing path length (Lges) for the purpose of introducing the pressing force into a filled-in portion of the loose material (M), and for returning the pressing plate (5) to a starting position, wherein the baling press further comprises a control and regulation system configured for monitoring a spatial orientation of a pressing surface (6) of the pressing plate and keeping it constant during the advancing movement of the pressing plate (5) over the pressing path length (Lges), wherein the multiple hydraulic cylinders are switched in parallel, by groups, wherein a first group (H1) of the multiple hydraulic cylinders (H11, H12 . . . Hn) switched in parallel is provided for generating the pressing force and transferring it to a displaceable intermediate plate (9), and wherein a second group (H2) of the multiple hydraulic cylinders (H21, H22 . . . Hn) switched in parallel is provided for generating the pressing force and transferring it to the pressing plate (5), so that the pressing plate (5) can be displaced relative to the intermediate plate (9) by means of the multiple hydraulic cylinders (H21, H22 . . . H2*n*).

2. The baling press (1; 11; 12) according to claim 1, in which the control and regulation system comprises a distance measurement device (30) for sequential measurement of actual distances between at least three collinear measurement points (31, 32, 33) on the pressing surface (6) of the pressing plate (5) or on the pressing plate (5), which is moving, and reference points (35, 36, 37) fixed on a frame, which define a desired orientation of the pressing surface (6), a measurement result evaluation unit (34) for determining deviations of the actual distances from predetermined desired distances, and a control circuit connected with the drive assemblies (A1, A2, A3, A4), for variation of a drive output for the purpose of equalizing differences between actual and desired distances by means of the hydraulic cylinders (H11, H12 . . . Hn, and H21, H22 . . . Hn), in real time.

3. The baling press (1; 11; 12) according to claim 2, in which the distance measurement between the measurement points and the reference points (31, 32, 33; 35, 36, 37) is provided optically by means of running-time measurement, laser triangular or evaluation of a phase position of reflected laser radiation, by means of potentiometers, using magnetic sensors, pneumatically, or on the basis of eddy current measurements.

4. The baling press (1; 11; 12) according to claim 1, in which the drive assemblies and the assigned hydraulic cylinders, for the purpose of compensating differences of counter-forces that act on the individual hydraulic cylinders (H11, H12 . . . Hn and H21, H22 . . . Hn) during compaction, are linked with one another by way of a synchronized control system and/or by way of a position regulation system, so that an orientation of the pressing plate (5) is constant relative to a pressing direction (P), during displacement over the pressing path length (Lges).

5. The baling press (1; 11; 12) according to claim 1, in which a separate drive assembly (A1 . . . A4) of the drive assembles (A1, A2, A3, A4) is assigned to each hydraulic cylinder (H11, H12 . . . Hn and H21, H22 . . . Hn), and each separate drive assembly (A1 . . . A4) has a hydraulic pump and a frequency inverter, the intermediate plate (9) can be displaced by a first partial pressing path length (L1), together with the pressing plate (5) by use of the first group (H1) of hydraulic cylinders (H11, H12 . . . Hn), the pressing plate (5) can be displaced by a second partial pressing path length (L2) relative to the intermediate plate (9) by use of the second group (H2) of hydraulic cylinders (H21, H22 . . . Hn), wherein it holds true that the first partial pressing path length ($L_1$) plus the second partial pressing path length ($L_2$) are equal to the pressing path length (Lges), and wherein the intermediate plate (9) is fixed in place when the first partial pressing path length ($L_1$) is reached.

6. The baling press (1; 11; 12) according to claim 5, wherein the hydraulic cylinders (H11, H12 . . . Hn) of the first group (H1) are disposed to either pull the intermediate plate (9) and/or the pressing plate (5) in a pressing direction (P) or to press it/them in the pressing direction (P), and the hydraulic cylinders (H21, H22 . . . Hn) of the second group (H2) are disposed to either pull the pressing plate (5) in the pressing direction (P) or to press it in the pressing direction (P).

7. The baling press (1; 11; 12) according to claim 6, wherein the first group (H1) comprises four hydraulic cylinders (H11 . . . H14) switched in parallel, or the second group (H2) comprises three hydraulic cylinders (H21 . . . H23) switched in parallel, or the first group (H1) comprises four hydraulic cylinders (H11 . . . H14) switched in parallel and the second group (H2) comprises three hydraulic cylinders (H21 . . . H23) switched in parallel.

8. The baling press (1; 11; 12) according to claim 1, in which a further hydraulic cylinder (H3) connected with the pressing plate (5) is present, configured for pushing a bale that has been completely pressed out of the pressing channel (3) after the pressing path length ($L_{ges}$) has been reached.

9. The baling press (1; 11; 12) according to claim 8, in which a joint drive assembly (A1 . . . A3) of the drive assemblies (A1, A2, A3, A4) is assigned jointly, in each instance, to one of three hydraulic cylinders (H11 . . . H13) of the first group (H1) and one of the hydraulic cylinders (H21 . . . H23) of the second group (H2), and a common drive assembly (A4) of the drive assemblies (A1, A2, A3, A4) is assigned to a fourth hydraulic cylinder (H14) of the first group (H1) and the hydraulic cylinder (H3) provided for pushing the bale out, wherein a 4/3-way valve (V11, V21; V12, V22; V13, V23; V14, V3) having a central shut-off position and two through-flow paths for alternate application to the hydraulic cylinders is disposed in the hydraulic line between each of the drive assemblies (A1 . . . A4) and the related hydraulic cylinders (H11 . . . H14; H21 . . . H23; H3), in each instance.

* * * * *